US006058685A

United States Patent [19]

Wotring

[11] Patent Number: 6,058,685

[45] Date of Patent: May 9, 2000

[54] SADDLE CINCH

[76] Inventor: Randall Curtis Wotring, 19600 Beck Rd., Northville, Mich. 48167

[21] Appl. No.: 09/033,385

[22] Filed: Mar. 2, 1998

[51] Int. Cl.[7] ..... B68C 1/00; B68C 1/14; B68C 1/04; A44B 11/00

[52] U.S. Cl. ..... 54/23; 54/44.3; 24/170; 24/265

[58] Field of Search ..... 54/4, 23, 35, 44.3, 54/46.1; 24/168, 68 E, 170, 265 BC, 265 R

[56] References Cited

U.S. PATENT DOCUMENTS

| | | | |
|---|---|---|---|
| 468,205 | 2/1892 | O'Sullivan | 54/23 |
| 567,278 | 9/1896 | Martin | 54/45.1 |
| 702,166 | 6/1902 | Wallace | 24/170 |
| 1,216,228 | 2/1917 | Grushus | 54/23 |
| 1,531,672 | 3/1925 | McLean | 267/74 |
| 2,044,869 | 6/1936 | Alkin | 24/265 WS |
| 3,042,986 | 7/1962 | Racette et al. | 24/170 |
| 3,641,739 | 2/1972 | Stubben | 54/23 |
| 3,646,644 | 3/1972 | Watts | 24/114.5 |
| 4,018,035 | 4/1977 | Morrison | 54/23 |
| 4,033,097 | 7/1977 | Petit | 54/44 |
| 4,502,266 | 3/1985 | Friedson | 54/44 |
| 4,709,539 | 12/1987 | Bird | 54/23 |
| 4,881,303 | 11/1989 | Martini | 54/23 |
| 4,987,653 | 1/1991 | Lin | 54/23 |
| 4,999,980 | 3/1991 | McGowan | 54/23 |
| 5,269,050 | 12/1993 | Yewer, Jr. | 24/170 |
| 5,500,959 | 3/1996 | Yewer, Jr. | 602/19 |
| 5,588,184 | 12/1996 | Chen | 24/170 |
| 5,732,448 | 3/1998 | Shields et al. | 24/180 |
| 5,749,127 | 5/1998 | Hsieh | 24/3.13 |

*Primary Examiner*—Michael J. Carone
*Assistant Examiner*—Son T. Nguyen
*Attorney, Agent, or Firm*—Price, Heneveld, Cooper, DeWitt & Litton

[57] ABSTRACT

A saddle cinch includes a collar defining an elongate opening, a strap lock connected to the collar, the connected collar and strap lock defining a cinch subassembly, and a strap connected to the cinch subassembly. Among other advantages, the saddle cinch allows a rider to tighten the cinch strap without dismounting, while eliminating the need for tying the cinch strap to the saddle ring, while also allowing multiple passes through the saddle ring and girth ring to achieve a theoretical 4:1 mechanical advantage, as is customary.

17 Claims, 3 Drawing Sheets

SADDLE CINCH

FIELD OF THE INVENTION

This invention relates generally to saddle cinches for connecting a saddle to a belly girth and for tightening the belly girth, and, more particularly, to saddle cinches having a strap and a strap lock to allow quick connection of the belly girth and the saddle and quick tightening of the belly girth.

BACKGROUND OF THE INVENTION

Traditional Western style saddles have been connected with the belly girth using a leather strap or saddle cinch which is fastened to a first ring hanging at the end of a strap connected to the saddle, threaded through a second ring connected at one end of the belly girth, again looped through each of the rings, tightened, and tied in a knot around the first ring. By looping the strap through each of the rings twice, a theoretical 4:1 mechanical advantage is achieved which makes it easier for the rider to tighten the belly girth and saddle when pulling on the free end of the strap before it is tied to the first ring. Despite efforts to employ modern strapping materials and fasteners such as buckles, leather saddle cinches which are tied to the saddle ring are almost exclusively used and preferred by most Western style riders. This is so even though the use of leather strapping has many disadvantages.

One obvious disadvantage with leather is that it tends to stretch while under tension during use. Also, exposure to weather, such as high or low temperatures, sunlight, rain, snow, and high or low humidity, affects leather, causing it to shrink or expand, depending on the particular conditions to which it is exposed. As a consequence, it may be necessary to readjust the tension on the cinch strap merely on account of the properties of the leather strap. This is significant because, with leather saddle cinches, the rider must demount in order to adjust the tension on the belly girth and saddle. In addition to disrupting the ride and taking away from the riders time, demounting to readjust the tension on the cinch strap and remounting thereafter increases the potential for injury, as most injuries associated with riding a horse occur during mounting or dismounting. Another disadvantage with leather strap cinches is that the leather deteriorates with use and with exposure to various weather conditions. As a result, equine outfitters and riders must depend on their observations, experience and judgment to determine when to replace the cinch on account of leather deterioration to prevent a failure from occurring during a ride. A further disadvantage with conventional leather cinches is that it can be difficult and time consuming, especially for a neophyte rider, to properly tension and tie the cinch strap. Finally, leather is a relatively expensive material.

Attempts to overcome some of the disadvantages with leather cinch straps have included using polymeric strapping or webbing comprising a fabric made from polymeric fibers, such as polypropylene or nylon. Such materials are relatively inexpensive, substantially unaffected by weather, exhibit very little stretching under load, and are extremely durable. Accordingly, it was believed that the use of polymeric strapping in place of leather would reduce the need for adjusting tension during a ride, because the polymeric strapping would not be expected to shrink or expand. While the above advantages were realized in a technical sense, the lubricous qualities of polymeric strapping caused the knot used to tie the free end of the strap to the saddle ring to loosen during a ride. As a result, the use of polymeric strapping in place of leather did not significantly reduce the need for demounting to readjust the tension around the saddle, saddle cinch and belly girth, but instead, was believed to actual increase the need for adjusting tension during a ride. Consequently, the mere substitution of polymeric strapping in place of leather, in an otherwise traditional saddle cinch, has not met with approval by equine outfitters and riders.

In order to eliminate the need for tying the cinch strap to the saddle ring, buckles have been used. The use of buckles in saddle cinches makes it easier to connect the saddle with the belly girth, and allows quicker adjustment or readjustment of the tension. However, known saddle cinches of this type have generally employed conventional buckles having a frame and one or more tongues pivotally connected to the frame, with the tongue(s) passing through an opening(s) at the free end of the cinch strap. This arrangement has many serious disadvantages. One disadvantage is that the load tension is not uniformly distributed across the width of the strap in the area of the buckle, but is instead focused on the area immediately adjacent the opening through which the tongue passes through the strap. The tongue hole creates a discontinuity in the strapping, compromising its integrity of the cinch strap, and the uneven distribution of forces focused in the area immediately adjacent to the tongue hole can have a severely adverse effect on the inherently high strength and excellent durability properties of the polymeric strapping. Another disadvantage with known saddle cinches having a buckle with one or more tongues is that the cinch strap can only be tightened in discrete increments corresponding to the available tongue openings in the strap. Also, it is generally necessary to pull the strap slightly tighter than desired to compensate for the slack which occurs when the tongue is rotated from the position in which the free end of the tongue is first inserted through the strap to the position in which the free end of the tongue engages the frame of the buckle. Known saddle cinches for connecting the free end of the cinch strap to the saddle have employed a design which allows the cinch strap to be threaded through the saddle and girth rings only once. As a result, such cinches do not achieve the theoretical 4:1 mechanical advantage of traditional saddle cinches. Consequently, saddle cinches with buckles have not met with widespread approval among equine outfitters and riders.

A common disadvantage with all known saddle cinches, including traditional leather strap cinches, polymeric strap cinches, and cinches having a buckle, is that a rider cannot adjust the strap tension while on the horse, but must instead dismount, make the desired adjustment, and remount. Such adjustments involve time and effort, and detract from the enjoyment of the riding experience. As a result, some riders may decide not to make an appropriate adjustment when needed. A decision not to make a needed adjustment could put the safety of the rider at risk. For example, regardless of the characteristics of the saddle cinch, it may become necessary to tighten the cinch strap to compensate for settling and compression of the saddle and saddle pad during riding. A failure to make an appropriate adjustment could result in the saddle sliding away from its proper position on the back of the horse and this could cause injury to the rider. As another example, it may become necessary to loosen the cinch strap to compensate for expansion of the chest of the horse during riding, on account of the horse requiring more air during exercise than during rest. If the cinch strap is not loosened in such case, the horse may experience discomfort and react violently, possibly causing injury to the rider. On the other hand, mounting and dismounting are relatively risky actions as compared with normal riding. Another disadvantage with being unable to adjust the cinch strap tension while in the saddle is that the rider must estimate how much the strap should be overtightened to compensate for compression of the saddle and saddle pad when the rider is in the saddle. Because of the difficulty in accurately estimating this effect, it is extremely difficult to achieve a highly accurate tension in which the saddle is secure, but which is not so tight as to cause objectionable discomfort to the horse. A relative disadvantage of having to adjust the saddle cinch strap tension while standing next to the horse as compared with being able to adjust the tension while in the saddle is that it is easier and more natural to tension a strap by pulling upwardly from the saddle than it is by pulling upwardly while standing on the ground. Clearly, it would be desirable to provide means for allowing the cinch strap to be adjusted without dismounting.

A further disadvantage with known saddle cinches is that the rider cannot quickly, easily and safely release excess tension in an emergency in which the horse suddenly becomes upset or violent on account of discomfort due to excess tension between the saddle and girth.

SUMMARY OF THE INVENTION

The invention provides a saddle cinch which allows a rider to tighten the cinch without dismounting and allows easier connection of the saddle to the belly girth, while allowing multiple passes of the cinch strap through the saddle ring and girth ring to achieve the theoretical 4:1 mechanical advantage. The invention also allows faster and more accurate adjustment of the cinch strap at any desired tension.

The cinch strap of this invention includes a collar defining an elongate opening, a strap lock connected to the collar, the connected collar and strap lock defining a cinch subassembly, and a strap connected to the cinch subassembly.

In accordance with a preferred aspect of the invention, the strap is made of a woven or knitted fabric comprised of polymeric fibers. The polymeric fabric strap is not subject to stretching, shrinkage or expansion, and will not loosen because it is held by a strap lock, rather than being tied to the saddle ring. Accordingly, the need for adjusting tension during a ride is reduced.

In accordance with another aspect of the invention, the strap lock comprises a base and a lever pivotally connected to the base, the lever being pivotal with respect to the base between a first position in which the strap is lockably positionable between the base and the lever, and a second position in which the strap is slidably positionable between the base and the lever. Rather than limiting tension adjustments to discrete increments, as is the case with known cinches employing a buckle, the strap lock allows accurate adjustment at any desired tension. The strap lock also allows immediate release of tension, as may be desired in an emergency situation in which the horse is experiencing discomfort due to excessive tensioning of the cinch strap.

In accordance with a further aspect of the invention, a saddle cinch is provide which merges the advantages of polymeric strapping and a strap lock while eliminating the disadvantages thereof. More specifically, by employing a strap lock which is capable of quickly and easily securely retaining a polymeric strap, it is possible to take advantage of the beneficial characteristics of polymeric strapping (e.g., dimensional stability, durability and strength) while eliminating the disadvantages associated with high lubricity of polymeric strapping which tends to allow the polymeric strapping to loosen if it is tied around the saddle ring, as is the case with known saddle cinches employing polymeric strapping.

In accordance with another aspect of the invention, the base of the strap lock defines a strap receiving channel and the lever includes a strap engagement member which projects from the lever toward the strap receiving channel of the base when the lever is in the first position. The strap engagement member and strap receiving channel are spaced apart by a distance which is less than the thickness of the strap when the lever is in the first (locked) position, whereby the strap is lockably positionable between the strap engagement member and the strap receiving channel. Preferably, the strap engagement member extends along the entire width of the strap receiving channel, whereby load forces may be distributed across the entire width of the strap to prevent uneven wear and extend the useful life of the saddle cinch.

DESCRIPTION OF THE PREFERRED EMBODIMENTS

Figure 1:
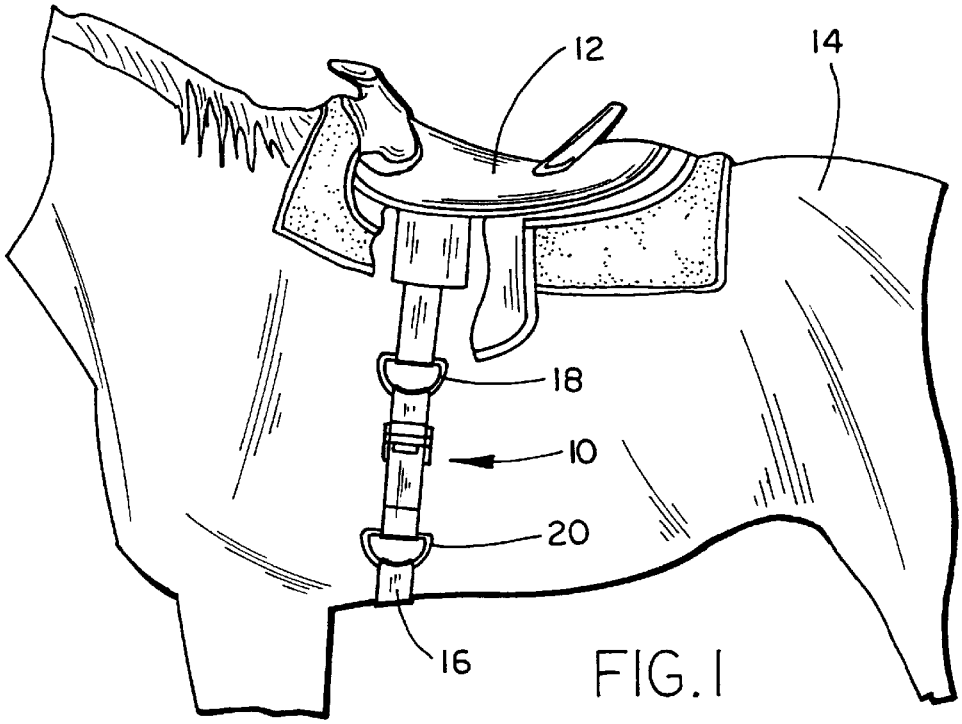
FIG. 1 is a fragmentary, side elevational view of a saddle and belly girth connected on a horse using the saddle cinch of the invention.

In FIG. 1 there is shown a saddle cinch 10 connecting a Western style saddle 12, mounted on a horse 14, to a Western style belly girth 16. More specifically, saddle cinch 10 is looped through saddle ring 18 and girth ring 20 in a manner described hereinafter to securely connect saddle 12 with belly girth 16 and securely hold saddle 12 on the back of horse 14.

Figure 2:
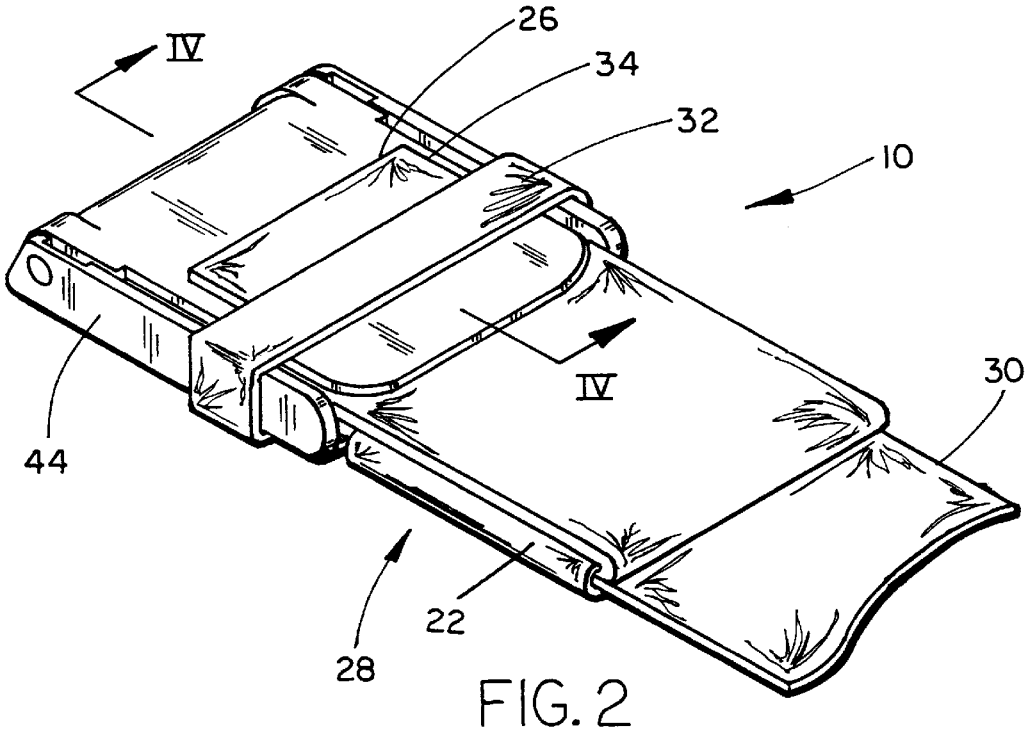
FIG. 2 is a fragmentary, perspective view of the saddle cinch.
Figure 3:
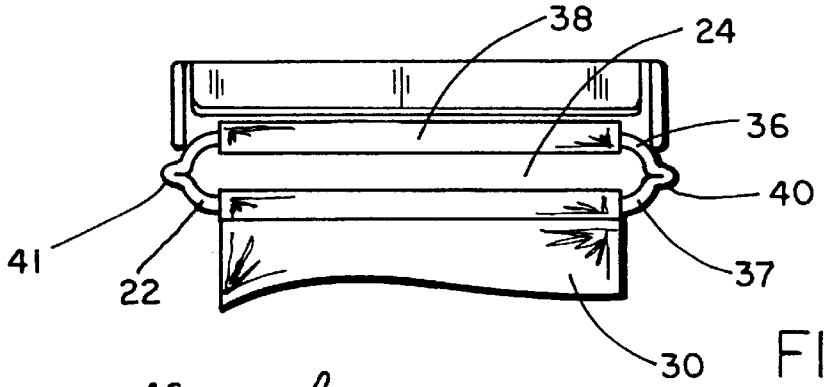
FIG. 3 is a fragmentary, end view of the collar of the saddle cinch shown in FIG. 2.

As shown in FIG. 2, saddle cinch 10 includes a collar 22 defining an elongate opening 24 (shown in FIG. 3), a strap lock 26 connected to collar 22, the connected collar and strap lock together defining a cinch subassembly 28, and a strap 30 connected to the cinch subassembly. A safety band 32 is slidably disposed on the cinch subassembly 28, and is slidable over the strap lock 26 to securely retain the strap lock in the closed position in which strap 30 may be lockably retained. The safety band 32 includes a tab portion 34 which projects laterally from the safety band to provide a finger hold which can be gripped to slide safety band 32 over strap lock 26 as shown in FIG. 2.

In the illustrated embodiment, the collar 22 is defined by rectangularly shaped fabric panels 36 and 37 which are joined at their edges to form a continuous loop or band, by an end of strap 30 which is wrapped around and secured to panel 37, and by a fabric strip 38 which is wrapped around and secured to panel 36. In the illustrated embodiment, fabric panels 36 and 37 are stitched together, preferably with a polymeric fiber such as polypropylene or nylon, and the edges are seared to form seams 40, 41. Searing of the edges gives the seams a smooth, finished edge, providing a good appearance, and also creates strong, unitary seams.

In the illustrated embodiment, collar 22 is connected with strap lock 26 by looping fabric strip 38 through rod 42 which extends transversely across strap lock 26.

Figure 4:
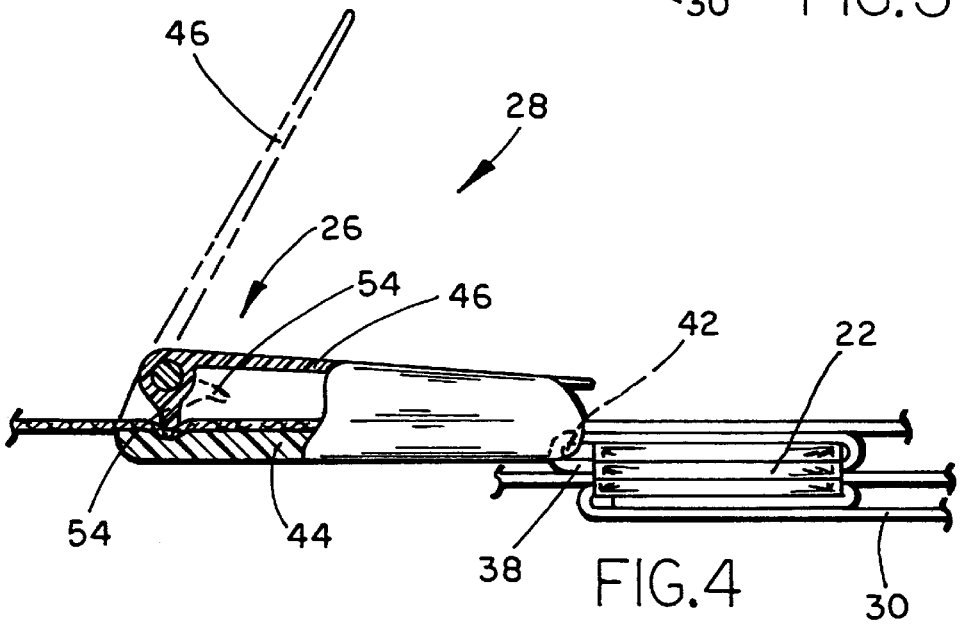
FIG. 4 is a fragmentary, cross-sectional view of the strap lock as seen along lines IV—IV of FIG. 2.
Figure 4A:
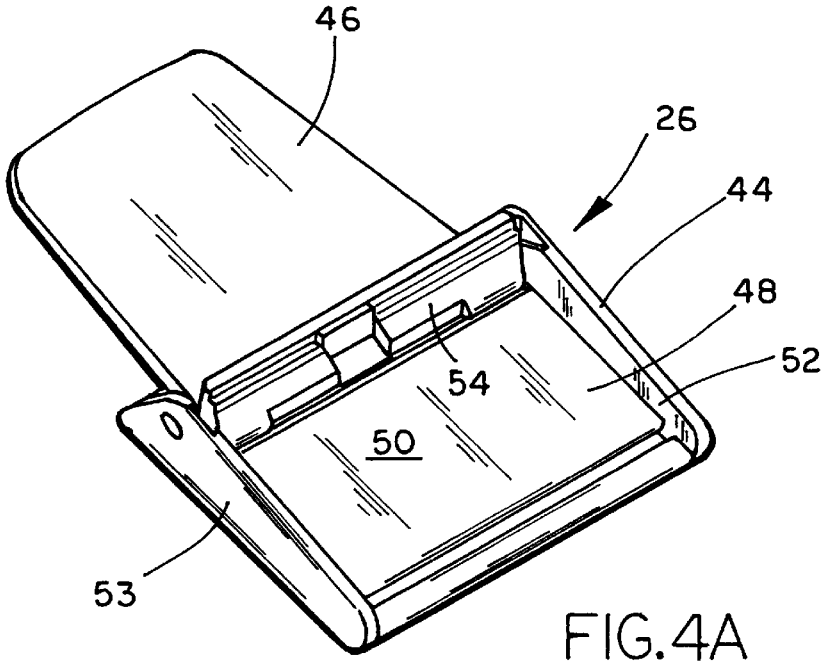
FIG. 4A is a perspective view of the strap lock with the lever pivoted into an open or unlocked position.

Strap lock 26 comprises a base 44 and a lever 46 which is pivotable with respect to the base between a first, locked position (shown with solid lines in FIG. 4) in which strap 30 is lockably positionable between the base and the lever, and a second position (shown in fantom in FIG. 4) in which strap 30 is slidably positionable between the base and the lever. As shown in FIG. 4A, base 44 of strap lock 26 includes a strap receiving channel defined by a floor 50 and walls 52, 53 which projects upwardly at approximately a right angle along opposite lateral edges of floor 50. Lever 46 includes a strap engagement member 54 which projects from lever 46 toward strap receiving channel 48 when lever 46 is in the first, locked position as shown in FIG. 4. The strap engagement member 54 and the floor 50 of the strap receiving channel 48 are spaced apart by a distance which is less than the thickness of the strap when the lever is in the first, locked position, whereby strap 30 can be lockably disposed between strap engagement member 54 and strap receiving channel 48. When lever 46 is pivoted to a second, open or unlocked position, such as the position of lever 46 represented in fantom in FIG. 4, strap engagement member 54 is sufficiently spaced away from floor 50 of strap receiving channel 48 so as to allow strap 30 to be freely slidable between base 44 and lever 46. Preferably, strap engagement member 54 extends along the entire width of strap receiving channel 48, whereby load forces may be substantially uniformly distributed across the entire width of strap 30.

Although the illustrated strap lock is preferred, it should be understood that other strap locks, such as conventional buckles, can be beneficially employed in the saddle cinch of the present invention. However, all of the benefits of the invention may not be achieved by employing certain types of strap locks. For example, while a saddle cinch comprising a collar, a conventional buckle connected to the collar, the connected collar and buckle defining a cinch subassembly, and a strap connected to the cinch subassembly, is considered to be within the scope of the appending claims, a saddle cinch of this type would not, for example, reduce or eliminate uneven wear of the cinch strap, although it would have many advantages common with the illustrated embodiment, such as allowing a rider to readjust the cinch strap tension without demounting.

Figure 5:
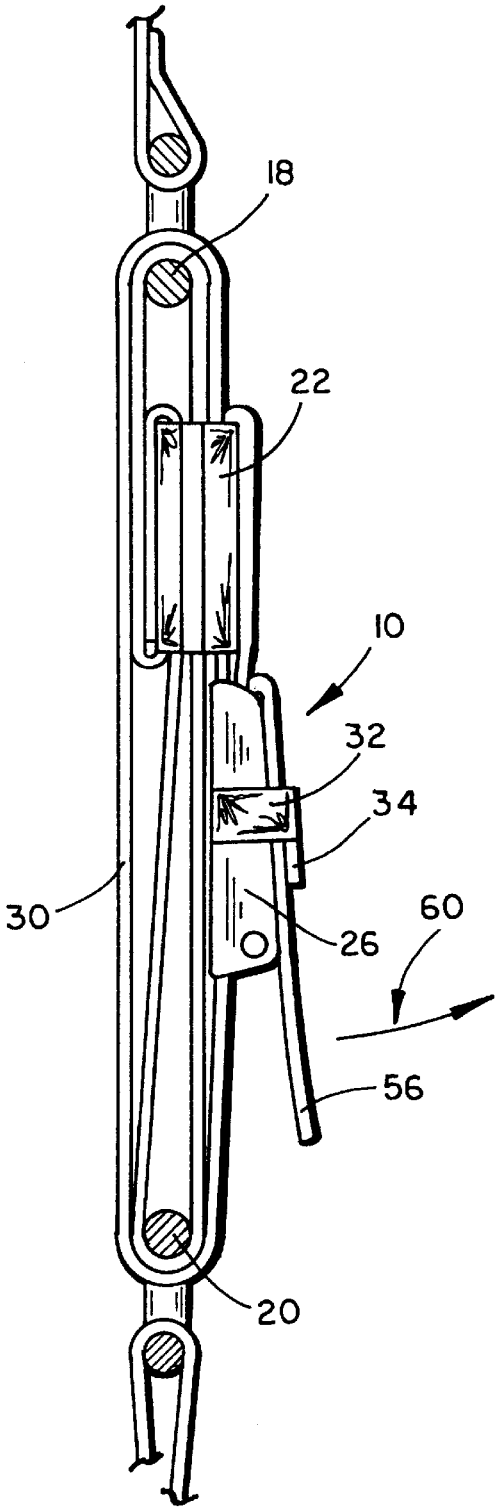
FIG. 5 is a fragmentary, side elevational view showing how the strap of the saddle cinch is looped through the saddle ring, girth ring, and collar of the saddle cinch to connect the saddle with the belly girth.

The manner in which saddle cinch 10 is used for connecting a saddle to a belly girth is shown in FIG. 5. Strap 30 is first wrapped around saddle ring 18 and down through collar band 22. Strap 30 is then pulled through girth ring 20 and pushed up through collar 22 behind strap lock 26. Then, strap 30 is again looped through saddle ring 18 and saddle ring 20, and through strap lock 26 between base 44 and lever 46. The end of strap 30 is then pulled until the desired tension is achieved. With proper tension on the cinch strap, lever 46 is pivoted to the locked position to securely retain the strap at the desired tension. Thereafter, the end of strap 30 may be folded downwardly over the front of collar 22 and through safety band 32 between the front of strap lock 26 and the inner surface of the front side of safety band 32. Desirably, safety band 32 is pulled downwardly over strap lock 26 to the position shown in FIG. 5. This serves two purposes. First, the free end 56 of strap 30 is neatly folded out of the way so that it is not inadvertently pulled, as this could cause the strap lock to unexpectly unlock and release the cinch strap. Second, this arrangement places the free end 56 of strap 30 in a position where it can be easily grasped and pulled upwardly and outwardly in a direction generally indicated by arrow 60 to provide immediate release of excessive tension, or to allow easy disconnection of the saddle cinch from the saddle and girth. When the free end 56 of strap 30 is pulled upwardly and outwardly, strap 30 lifts up on tab 34 pulling safety band 32 upwardly beyond the upper end of strap lock 26, and also causes strap 30 to urge lever 46 into the open or unlocked position so that strap 30 can be freely slid upwardly or downwardly in strap receiving channel 48 to allow easy adjustment of tension or removal of the saddle cinch.

Figure 6:
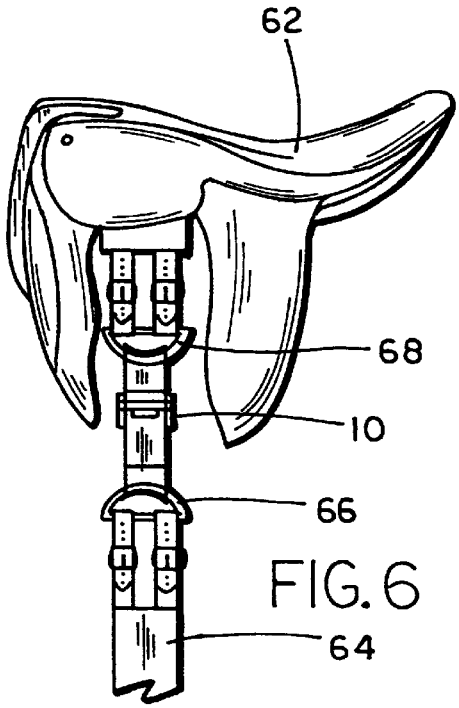
FIG. 6 is a side elevational view showing how the saddle cinch of the present invention may be used for connecting an English style saddle with an English style belly girth.

Although the saddle cinch of this invention is expected to be used more frequently with Western style saddles, it can also be adapted for use with English style saddles. FIG. 6 shows the saddle cinch being used for connecting an English style saddle 62 with an English style belly girth 64. Traditionally, an English style belly girth includes buckles for connecting the belly girth to billets which depend directly from the English style saddle. Accordingly, when using saddle cinch 10 with an English style saddle, a shorter belly girth will be used.

Figure 8:
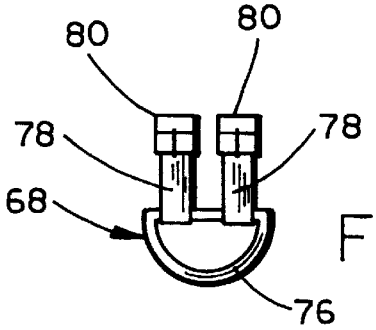
FIG. 8 is a perspective view of a saddle attachment for facilitating connection of the saddle cinch with an English style saddle.
Figure 7:
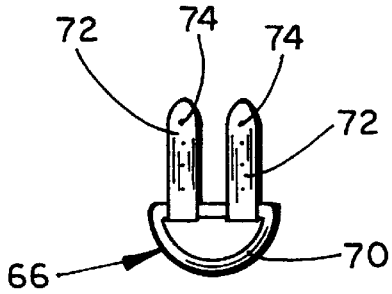
FIG. 7 is a perspective view of a girth attachment for facilitating connection between the saddle cinch and an English style belly girth.

Also, a girth attachment 66 and a saddle attachment 68 are used to adapt the English style girth and English style saddle, respectively, for use with saddle cinch 10. The girth attachment (shown in FIG. 7) includes a girth ring 70 for threading strap 30 therethrough in the manner previously described, and at least two girth attachment billets 72 which are connected to ring 70. Each of the girth attachment billets defines a plurality of tongue holes 74 which are spaced apart along the length of the girth attachment billets. The holes are adapted to receiving the tongue of a buckle on a girth to allow fastening of free ends of the girth attachment billets to buckles on the girth. The saddle attachment (shown in FIG. 8) includes a saddle ring 76 and at least two saddle attachment straps 78. Each of the saddle attachment straps has a buckle 80 attached at its free end for fastening a billet depending from the English style saddle. After the girth attachment has been properly buckled to the English style girth, and the saddle attachment has been properly buckled to the English style saddle, saddle cinch 10 may be used in the manner described above with respect to Western style saddles.

In the illustrated embodiment, strap lock 26 is a commercially available product sold by Fixfabriken Goteborg, Sweden, which is sold under the name "Fixlock® 350". Although the collar 22 of the illustrated embodiment is constructed from fabric panels, it may, as an alternative be made of a molded or extruded plastic material. It is also contemplated that the base 44 of strap lock 26 and collar 22 may be molded as a single unitary subassembly. Strap 30, fabric panels 36 and 37, and fabric strip 38 are comprised of a woven or knitted fabric, which is preferably comprised of polymeric fibers, with polypropylene and nylon fibers being preferred.

From the above description, it can be seen that saddle cinch 10 has many advantages over known saddle cinches. The saddle cinch of this invention allows a rider to tighten the cinch without dismounting, while allowing multiple passes to achieve the theoretical 4:1 mechanical advantage to which riders and equine outfitters are accustomed. Because saddle cinch 10 does not rely on tying a knot to secure the free end of strap 30 to saddle ring 18, but instead uses a strap lock, installation, removal, and readjustments of the tension are more easily performed. Because strap 30 is made of polymeric fibers, preferably nylon or polypropylene, strap 30 is extremely strong, durable, and is not subject to stretching or shrinkage or expansion due to weather conditions. Accordingly, tension adjustments are not required to compensate for characteristics of the strap material. Because the rider can adjust the tension on the strap while in the saddle, there is no need for estimating the effect of the riders weight on tension due to compression of the saddle and saddle pad. Accordingly, accurate tensioning is more easily facilitated. Unlike saddle cinches which utilize conventional buckles having a tongue which projects through one of a plurality of spaced apart tongue openings in the strap, whereby tension selection is limited to discrete values, saddle cinch 10 allows tension to be adjusted to any desired level. Further, the strap lock does not require any over tensioning in order to compensate for the action of lever 46 as it is pivoted from an unlocked to a locked position, whereas convention buckles require a slight amount of over tensioning to allow the tongue of a conventional buckle to be inserted through a tongue opening in a strap. The strap engagement member 54 of lever 46 of strap lock 26 extends across the width of strap 30 to allow uniform distribution of load across the width of the strap, thereby avoiding the problems of conventional straps and buckles wherein forces are focused at an area immediately adjacent a tongue hole. Thus, strap 30 of saddle cinch 10 is not subjected to excessive wear and will consequently have a long useful life.

In addition to the above advantages, and other advantages enumerated herein, those having ordinary skill in the art will likely recognize other advantages in the invention described herein.

What is claimed is:

1. A method of connecting a saddle disposed on the back of a horse with a belly girth connected at a first end thereof to the saddle on a first side thereof, a first ring depending from a second side of the saddle, and a second ring connected with a second end of the belly girth, comprising:

providing a saddle cinch including a collar defining a band for receiving and guiding multiple passes of a strap, a strap lock connected to the collar, and a strap connected to the collar, the strap lock comprising a base and a lever pivotally connected to the base, the lever being pivotable with respect to the base between a locked position in which the strap is lockably postionable between the base and the lever, and an unlocked position in which the strap is slidably positional between the base and the lever;

threading the strap through the first ring, then downwardly through the collar, then through the second ring, then upwardly through the collar, then again through the first ring, then again through the second ring, then upwardly through the strap lock while the lever is in the unlocked position;

thereafter pulling on the strap to apply a desired tension thereto; and locking the strap lock by pivoting the lever thereof to the locked position to securely retain the strap at the desired tension.

2. A saddle cinch connecting a saddle on a back of a horse with a belly girth, in which the belly girth is connected at a first end to a first side of the saddle, the belly girth having a first ring depending from a second side of the saddle and a second ring connected with a second end of the belly girth, comprising:

a collar defining a band for receiving and guiding multiple passes of a strap;

a strap lock, and a strap connected to the collar, the strap lock comprising a base and a lever pivotally connected to the base, the lever being pivotable with respect to the base between a locked position in which the strap is lockably positionable between the base and the lever, and an unlocked position in which the strap is slidably positionable between the base and the lever; the strap passing through the first ring, downwardly through the collar, through the second ring, upwardly through the collar, again through the first ring, again through the second ring, and upwardly through the strap lock.

3. The saddle cinch of claim 2 wherein the base includes a strap receiving channel defined by a floor and walls projecting from the floor, and wherein the lever includes a strap engagement member which projects from the lever toward the strap receiving channel of the base when the lever is in the first position, the strap engagement member and the floor of the strap receiving channel being spaced apart by a distance which is less than the thickness of the strap when the lever is in the first position, whereby the strap is lockably positionable between the strap engagement member and the strap receiving channel.

4. The saddle cinch of claim 3 wherein the strap engagement member extends along the entire width of the strap receiving channel, wherein load forces are distributable across the width of the strap.

5. The saddle cinch of claim 2 wherein the strap is comprised of polymeric material.

6. The saddle cinch of claim 2 wherein the strap is comprised of a woven or knitted fabric.

7. The saddle cinch of claim 6 wherein the woven or knitted fabric is comprised of polymeric fibers.

8. The saddle cinch of claim 7 wherein the polymeric fibers are comprised of polypropylene or nylon.

9. The saddle cinch of claim 2 further comprising a safety band slidably disposed on the cinch subassembly, the safety band being slidable over the strap lock to securely retain the lever in the first position in which the strap is lockably positionable between the base and the lever.

10. The saddle cinch of claim 9 wherein the safety band is comprised of a woven or knitted fabric.

11. The saddle cinch of claim 10 wherein the fabric safety band is comprised of polymeric fibers.

12. The saddle cinch of claim 11 wherein the polymeric fibers comprising the fabric safety band are comprised of polypropylene or nylon.

13. The saddle cinch of claim 9 wherein the safety band includes a tab portion which projects laterally therefrom to provide a finger hold.

14. The saddle cinch of claim 2 wherein the collar is defined by fabric panels.

15. The saddle cinch of claim 14 wherein the fabric panels are comprised of a woven or knitted fabric.

16. The saddle cinch of claim 15 wherein the woven or knitted fabric panels of the collar are comprised of polymeric fibers.

17. The saddle cinch of claim 16 wherein the polymeric fibers of the fabric panels of the collar are comprised of polypropylene or nylon.

* * * * *